US012693049B2

(12) United States Patent
Veprik

(10) Patent No.: US 12,693,049 B2
(45) Date of Patent: Jul. 28, 2026

(54) COMPACT INTEGRAL STIRLING LINEAR CRYOCOOLER

(71) Applicant: CRYO TECH LTD., Ein Harod (IL)

(72) Inventor: Alexander Veprik, Kiriyat Motzkin (IL)

(73) Assignee: CRYO TECH LTD., Ein Harod (IL)

( * ) Notice: Subject to any disclaimer, the term of this patent is extended or adjusted under 35 U.S.C. 154(b) by 625 days.

(21) Appl. No.: 18/112,503

(22) Filed: Feb. 22, 2023

(65) Prior Publication Data

US 2024/0280298 A1 Aug. 22, 2024

(51) Int. Cl.
*F25B 9/14* (2006.01)

(52) U.S. Cl.
CPC ..... *F25B 9/14* (2013.01); *F25B 2309/001* (2013.01)

(58) Field of Classification Search
None
See application file for complete search history.

(56) References Cited

U.S. PATENT DOCUMENTS 3,786,269 A * 1/1974 Cooper ..... G01J 5/08 348/E3.01
4,255,658 A * 3/1981 Hurst ..... H04N 23/23 348/E5.09
4,474,036 A * 10/1984 Ball ..... F17C 3/085 62/51.1
4,475,335 A * 10/1984 Davey ..... F02G 1/0435 92/130 B
4,569,203 A * 2/1986 Rawlings ..... G01J 5/061 60/520
4,979,368 A * 12/1990 Stetson ..... F25B 9/14 220/288
5,056,317 A * 10/1991 Stetson ..... F25B 9/14 60/520
5,274,237 A * 12/1993 Gallagher ..... G01T 1/00 250/370.15

(Continued)

FOREIGN PATENT DOCUMENTS

CN 108375234 A * 8/2018 ..... F25B 9/14
CN 108413641 A * 8/2018 ..... F25B 39/00

(Continued)

*Primary Examiner* — Jenna M Maroney
(74) *Attorney, Agent, or Firm* — PEARL COHEN ZEDEK LATZER BARATZ LLP

(57) ABSTRACT

An integral cryocooler includes a cold finger within an elongated space defined inside an elongated housing. A tip of the cold finger freely protrudes outside an opening at an exterior end of the housing, and a root of the cold finger is supported in a cantilevered manner at an interior end of the housing. A cryocooler cover sealingly connected to the housing forms a pressure vessel. A ferromagnetic mover is coaxially fixed to a movable capped cylinder that is located within the pressure vessel and surrounds the interior end of the housing to form a compression space. A stator is located outside the pressure vessel and includes two cylindrical permanent magnets with opposite and axial magnetization that surround a driving coil. When an alternating electrical current flows through the driving coil, the movable capped cylinder is moved axially back and forth to alternately compress and expand the compression space.

19 Claims, 4 Drawing Sheets

(56) References Cited

U.S. PATENT DOCUMENTS 5,404,016 A * 4/1995 Boyd ..... F17C 13/006 250/352
5,552,608 A * 9/1996 Gallagher ..... H01J 37/244 250/397
5,811,816 A * 9/1998 Gallagher ..... F17C 3/085 250/397
5,834,778 A * 11/1998 Veyrier ..... H10F 77/60 250/370.15
5,966,945 A * 10/1999 Mengel ..... F25D 19/006 62/51.1
6,094,912 A * 8/2000 Williford ..... F02G 1/0435 60/520
6,141,971 A * 11/2000 Hanes ..... F25B 9/14 60/520
6,327,862 B1 * 12/2001 Hanes ..... F25B 9/14 62/51.2
6,694,730 B2 * 2/2004 O'Baid ..... F02G 1/053 60/524
7,137,259 B2 * 11/2006 O'Baid ..... F25B 9/14 62/6
7,415,830 B2 * 8/2008 Wyatt ..... G01J 5/061 62/51.1
7,724,412 B2 * 5/2010 Powell ..... G01J 5/04 359/227
8,910,486 B2 * 12/2014 Bin-Nun ..... F25B 9/14 62/51.2
10,222,266 B2 * 3/2019 Veprik ..... H10F 10/19
2005/0223715 A1 * 10/2005 Kim ..... F25B 9/14 62/6
2006/0042272 A1 * 3/2006 Dietz ..... F25B 9/14 62/6
2008/0282706 A1 * 11/2008 Hon ..... F25B 9/00 62/3.7
2012/0079838 A1 * 4/2012 Bin-Nun ..... G01J 5/061 62/6
2015/0276488 A1 * 10/2015 Veprik ..... F16F 7/108 62/51.1
2017/0254570 A1 * 9/2017 Veprik ..... F16F 7/116
2021/0010720 A1 * 1/2021 Veprik ..... F25B 9/14
2021/0033313 A1 * 2/2021 Veprik ..... F02G 1/0535
2022/0250169 A1 * 8/2022 Veprik ..... H01L 21/6838
2023/0288103 A1 * 9/2023 Conrad ..... F25B 9/145
2024/0230168 A1 * 7/2024 Veprik ..... F25B 9/14

FOREIGN PATENT DOCUMENTS

CN 110625284 A * 12/2019 ..... B23K 31/02
CN 111765156 A * 10/2020 ..... F28F 9/26
EP 0324516 A1 * 7/1989 ..... F01B 11/001

* cited by examiner

COMPACT INTEGRAL STIRLING LINEAR CRYOCOOLER

FIELD OF THE INVENTION

The present invention relates to cryogenic refrigeration devices. More particularly, the present invention relates to a compact integral Stirling linear cryocooler.

BACKGROUND OF THE INVENTION

The second law of thermodynamics states that heat spontaneously flows from warmer objects to colder objects. The direction of heat flow may, however, be reversed by applying external work. This principle is employed in cooling devices such as heat pumps or refrigerators that are designed to extract heat at the location, which is maintained below environmental temperature, and reject it to a warmer environment. When such a location or heat generating payload is to be cooled and maintained at cryogenic temperature, such a refrigerator is sometimes referred to as a "cryocooler".

For example, a cryocooler may be used in a cooled infrared (IR) imager, the focal plane array (FPA) of which may be integrated with a readout integrated circuit (ROIC) whose operation may generate heat. Maintaining such a FPA at a cryogenic temperature reduces thermally-induced noise, thus enables desired spatial and temperature resolution. In this case, the total amount of heat which needs to be pumped from FPA to environment includes the active heat load (heat dissipated by the ROIC) along with the parasitic passive heat inflows comprising conductive, radiative and convective components.

Typically, such a cryocooler operates based on a closed Stirling thermodynamic cycle.

SUMMARY OF THE INVENTION

There is thus provided, in accordance with an embodiment of the invention, an integral cryocooler including: a cold finger within an elongated space defined inside an elongated housing, wherein a tip of the cold finger freely protrudes outside an opening at an exterior end of the elongated housing, and wherein a root of the cold finger is supported in a cantilevered manner at an interior end of the elongated housing; a cryocooler cover sealingly connected to the elongated housing to form a pressure vessel; a ferromagnetic mover coaxially fixed to a movable capped cylinder that is located within the pressure vessel and surrounds the interior end of the elongated housing to form a compression space; and a stator, located outside the pressure vessel and including two cylindrical permanent magnets with opposite and axial magnetization surrounding a driving coil, such that when an alternating electrical current flows through the driving coil, the movable capped cylinder is moved axially back and forth to alternately compress and expand the compression space.

Furthermore, in accordance with an embodiment of the invention, most of a length of the cold finger lies within the elongated space.

Furthermore, in accordance with an embodiment of the invention, the cold finger includes a displacer that is filled with a regenerator and that is configured to move axially back and forth within the cold finger to transfer heat from the tip to the root when the cold finger and the compression space are filled with a gaseous working agent and the alternating current flows through the driving coil, an interior end of the displacer including a displacer magnet in the form of an axially magnetized permanent ring magnet.

Furthermore, in accordance with an embodiment of the invention, a tubular magnet whose permanent axial magnetization is opposite to the displacer magnet is fixed relative to the elongated housing such that the displacer magnet is configured to move within the tubular magnet during the axial motion of the displacer to form a magnetic spring.

Furthermore, in accordance with an embodiment of the invention, the magnetic spring and displacer are configured such that a resonant frequency of the axial motion of the displacer is equal to a predetermined resonant frequency.

Furthermore, in accordance with an embodiment of the invention, the predetermined resonant frequency is substantially equal to a frequency of the alternating electrical current.

Furthermore, in accordance with an embodiment of the invention, the regenerator includes a bundle of axially aligned strands.

Furthermore, in accordance with an embodiment of the invention, the strands include polyester or nylon strands having diameters in the range of 4 μm to 15 μm.

Furthermore, in accordance with an embodiment of the invention, a porosity of the bundle is in the range of 65% to 85%.

Furthermore, in accordance with an embodiment of the invention, the root of the cold finger is supported in the cantilevered manner at the interior end of the elongated housing by a support ring that extends radially inward from the elongated housing.

Furthermore, in accordance with an embodiment of the invention, the root of the cold finger is laser or ion-beam welded to the support ring.

Furthermore, in accordance with an embodiment of the invention, at least a section of an outer surface of the elongated housing includes a piston liner.

Furthermore, in accordance with an embodiment of the invention, an inner surface of the movable capped cylinder is fixed to a cylinder liner.

Furthermore, in accordance with an embodiment of the invention, a radial clearance between the cylinder liner and the piston liner is sufficiently small so as to form a close clearance seal.

Furthermore, in accordance with an embodiment of the invention, the radial clearance is between 10 μm and 14 μm.

Furthermore, in accordance with an embodiment of the invention, the cylinder liner or the piston liner is made of wear-resistant high speed steel.

Furthermore, in accordance with an embodiment of the invention, the cryocooler cover includes a fill/purge valve that enables connection of the pressure vessel to a tap.

Furthermore, in accordance with an embodiment of the invention, the driving coil is edgewise wound.

Furthermore, in accordance with an embodiment of the invention, the cold finger tube includes extruded cobalt-chromium-tungsten-nickel alloy.

Furthermore, in accordance with an embodiment of the invention, the cylindrical permanent magnets included sintered neodymium-iron-boron powder.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
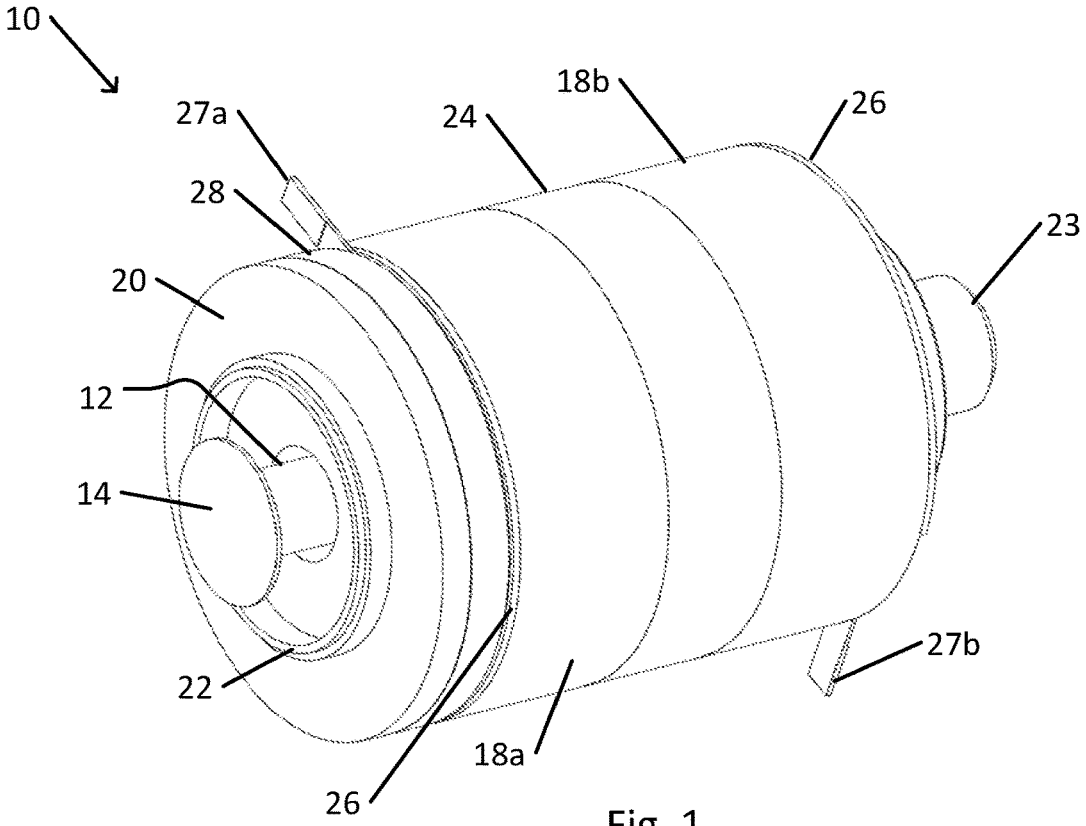
FIG. 1 schematically illustrates an example of an integral linear cryocooler, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the invention, an integral cryocooler includes a cold finger that may be operated to transfer heat from a cold finger tip at an exterior distal end of the cold finger to a cold finger root at an interior, proximal, and relatively warm end of the cold finger. Components of the cold finger are enclosed within a cold finger tube which may be filled with a gaseous working agent.

The cold finger root is supported in a cantilevered manner by an elongated cold finger housing. The cold finger tube is located within an elongated space that is formed within the cold finger housing, with the cold finger tip freely protruding (e.g., without mechanical contact with the housing or any other structure) outside an opening at an exterior distal end of the cold finger housing. Support structure of the cold finger housing for supporting the cold finger root is located at an interior point, e.g., at or near an interior end of the cold finger housing. A radial (e.g., cylindrical) gap separates the cold finger tube from the cold finger housing along the entire length of the cold finger tube that is exterior to the finger support structure. A cryocooler cover is attached or connected to the elongated housing to form a seal that that does not permit gas flow between the cryocooler cover and the housing, thus forming a pressure vessel.

A ferromagnetic mover, e.g., composed of or including a soft ferromagnetic material, is fixed, e.g., coaxially, to a movable capped cylinder located within the pressure vessel. The movable capped cylinder surrounds the interior proximal end of the elongated housing to form a compression space. A stator is located outside of the pressure vessel and includes a driving coil that is surrounded by two tubular permanent magnets with opposite axial magnetization. The stator and ferromagnetic mover form an axial actuator for axially driving the movable capped cylinder, and a displacer that is inside the cold finger.

To operate the cryocooler, alternating electrical current is caused to flow through the driving coil. The periodically varying magnetic field thus generated by the stator may interact with the ferromagnetic mover to alternately, e.g., periodically, drive the ferromagnetic mover and the attached movable capped cylinder in opposite axial directions, thus alternately compressing and expanding the gaseous working agent in the compression space. The alternate compression and expansion may drive alternating axial motion of a displacer that is enclosed within the cold finger tube, thus cooling the cold finger tip and any object that is in thermal contact with the cold finger tip.

The elongated housing may include housing flange that extends radially outward at its exterior end, e.g., to enable connection of the housing to the cryocooler housing, to external structure (e.g., an enclosure of an object to be cooled, to the stator, or any combination of the above.

Finger support structure, e.g., in the form of a ring or struts that extend radially inward, may be located at the interior end of the cold finger housing. The cold finger tip formed by the exterior capped end of the cold finger tube protrudes exteriorly beyond the housing flange.

The cryocooler cover includes a cover flange extending radially outward at its exterior (distal) end, and a cover that caps the wall at its interior (proximal) end. The cover flange may be connected to the housing flange so as to seal the interface between the flanges, and form the pressure vessel. The pressure vessel may be used to confine a pressurized gaseous working agent.

In order to make the cryocooler axially compact and mechanically simple, compression of the gaseous working agent is effected by the combination of a static piston and a movable capped cylinder. The static piston may be formed at the interior end of the cold finger housing. The radially outward-facing surface of the interior end of the cold finger housing may be lined by a piston liner. An inward-facing surface of the wall of the movable capped cylinder may be lined by a cylinder liner. An outward facing surface of the wall of the movable capped cylinder may be surrounded by the ferromagnetic mover of the axial actuator. The cylinder liner is configured to slide over the piston liner with an axial clearance that is sufficiently small to form a close clearance seal that pneumatically isolates a compression space, bounded by the stationary piston and the interior end of the movable capped cylinder distal end of the compressor housing, from the pressure vessel.

The stator of the axial actuator may be located externally to the pressure vessel, for example, coaxially surrounding the cryocooler cover. It includes a tubular driving coil, preferably of the edgewise type, and two axially and oppositely axially magnetized permanent magnet rings. The permanent magnet rings may be axially separated from one another by a nonmagnetic stator spacer, e.g., tubular and coaxial with the permanent magnet rings. For example, the axially outer ends of the permanent magnet rings may be axially adjacent to opposite ends of the driving coil, and the axially inner end of each permanent magnet ring may abut opposite ends of the stator spacer.

The displacer of the cold finger may be arranged to slide axially within the cold finger tube, forming a close clearance seal between the displacer and the walls of the cold finger tube. The displacer may be constructed of a tube made of a material with low heat conductance and high wear resistance, and that is filled with a regenerative heat exchanger. For example, the regenerative heat exchanger may be in the form of a radially confined bundle of axially arranged filaments, e.g., of nylon or polyester. An interior proximal end of the displacer tube is open to the compression space while its exterior distal end is open to an expansion space that is bounded by the cap covering the exterior end of the cold finger tube and the walls of the cold finger tube. Due to the close clearance seals between the displacer and the cold finger tube, pneumatic communication between the expansion space and the compression space is only possible through the regenerator material. During axial motion of the displacer, the displacer never extends outside of the cold finger tube.

The displacer may be provided with an axial spring. Thus, an axial driving drag force that is produced by a cyclic flow of the working agent through the porous material of the regenerative heat exchanger may result in periodic resonant axial motion of the displacer. For example, the axial spring may include a magnetic spring. The magnetic spring may include two coaxial, oppositely and axially magnetized magnet rings. A movable magnet ring may have a cross section that is similar to that of the displacer (e.g., circularly annular) and may be mounted on the displacer, e.g., at a proximal (warm) interior end of the displacer tube. A stationary elongated magnet ring may be mounted on, e.g., surrounding, a portion of the cold finger tube in which the displacer magnet ring is expected to travel, e.g., at or near the proximal interior end of the cold finger tube. The interaction between the movable displacer magnet ring and the stationary magnetic ring may produce a magnetic spring effect resulting in a restorative force that tends to move the displacer back toward an equilibrium central position when the displacer is axially displaced from the equilibrium central position. The spring constant of the magnetic spring and the mass of the displacer (and, in some cases, other factors) may determine a resonance frequency of the axial motion of the displacer. The magnetic spring constant may be configured such that the resonance frequency of the axial motion of the displacer is approximately equal to an optimum frequency of the cryocooler (e.g., a frequency of motion of the displacer that results in a maximum rate of heat transfer from the cold finger tip to the cold finger root).

The interior of the cold finger tube and the compression chamber (the term "compression chamber" being used herein interchangeably with the term "compression space") enclose an active portion of the gaseous working agent. The clearance seals formed by the tightly matched piston liner and cylinder liner separate the active portion from the compressor backspace, e.g., the volume of the pressure vessel that is outside of the compression chamber and the cold finger tube.

The movable capped cylinder is configured to be moved axially back and forth along the outward facing surface of the static piston. When the movable capped cylinder is moved distally such that the cap of the movable capped cylinder is moved into the compression chamber, the gaseous working agent may be compressed. When the movable capped cylinder is moved proximally out of the compression chamber, the gaseous working agent may expand. The cyclic compression and expansion of the gaseous working agent may produce cyclic pressure difference between the expansion and the compression space, thus resulting in a cyclic flow of the working agent through the regenerative heat exchanger. The cyclic flow may exert a cyclic drag force on the displacer resulting in an axial reciprocation of the displacer within the cold finger.

An axial actuator in the form of a moving iron actuator is provided for driving axially and reciprocally the movable capped cylinder to cyclically compress and expand the gaseous working agent. Such an axial actuator may include the stator assembly, located axially outside of the pressure vessel, e.g., axially outside of the cryocooler cover, and a tubular ferromagnetic mover that is inside the pressure vessel. The axial length of the ferromagnetic mover is shorter than the axial length of the driving coil and may be made of a magnetically soft ferromagnetic material. The ferromagnetic mover is attached to the movable capped cylinder so that the axial force magnetic exerted on the ferromagnetic mover is also exerted on the movable capped cylinder.

With no electrical current flow through the driving coil, and with tubular mover in a central axial position, the tubular mover is equally and oppositely attracted by the stator magnet rings. In this case, no axial force is exerted on the ferromagnetic mover. Thus, the central position of the mover is a position of mechanical equilibrium. When the ferromagnetic mover is displaced axially from the position of mechanical equilibrium toward one of the stator magnetic rings, the ferromagnetic mover will be more attracted to the more distant magnet ring than to the nearer magnet ring. The resultant restoring force will be directed, therefore, towards the position of equilibrium. This effect may be thought of as the restorative action of a magnetic spring.

Application of direct current across the driving coil is equivalent to addition of an additional coaxial tubular magnet, exerting an additional attractive force on the ferromagnetic mover. The magnitude and direction of this force will depend on the magnitude and direction of the direct current, the number of coils, and the magnet flux present in the air gap between permanent magnet rings and the ferromagnetic mover.

Application of alternating current across the driving coil, will result in exertion of an alternating axial force on the ferromagnetic tubular mover. The frequency and magnitude of this force will depend on the frequency and magnitude of the alternating current.

It may be noted, that the loss of magnetic flux due to the absence of a back iron may be compensated for by increasing the size of the magnet rings and driving coil.

It may be also noted, that in this arrangement, the tubular driving coil is located radially between the magnet rings and ferromagnetic tubular mover. When the driving coil is relatively thick (e.g., with single layered or multilayered edgewise-wound coils), radial forces exerted due to any lack of concentricity between the permanent ring magnets and the ferromagnetic mover may be reduced.

An integral inline cryocooler in accordance with embodiments of the invention may be advantageous over other types of cryocoolers that are based on the Stirling cycle.

Split linear, small size, low weight, and low power (SWaP) cryocoolers may include a linear piston compressor unit and a pneumatic expander unit that are placed in pneumatic communication through a flexible and configurable transfer line. Such a split configuration enables maximum flexibility in the packaging of compact hand-held and gyro-stabilized infrared imagers, in the face of numerous geometrical constraints, usually resulting from placement of components of the optical chain.

Disadvantages of such a split design concept are primarily related to the special shape of the transfer line as required to enable flexibility and connectivity, which may add parasitic aerodynamic friction. Welding of connections of the transfer line to the compressor and expander units may result in leakage of the gaseous working agent of the cryocooler. Split cryocoolers may be prone to mishandling and may require massive and expensive frames to support the compressor and expander units in order to protect the transfer line from excessive overstressing during integration into an enclosure. Additional disadvantages may result from unoccupied volume that surrounds the typically cylindrical compressor and expander units. Additionally, the spatial separation of the compressor unit from the expander unit may lead to generation of harmful vibrations resulting in image blurring.

In an integral inline configuration, the compressor and expander units are placed, collinearly, and may share common parts. Advantages of the inline configuration may result from elimination of the transfer line. Such advantages may include minimization or elimination of unoccupied volumes, parasitic pressure losses, and leakage at connections. An integral configuration may offer increased robustness, e.g., when being handled, may not require a support frame, and may be lighter than, and enable more convenient thermal, optical, and mechanical interfacing to a host system than, a split design. Consolidation of vibrational forces along a common axis may reduce or eliminate the generation of vibrational moments.

On the other hand, the inline configuration may extend the overall axial length of the device, which may be of concern for space-limited applications, such as handheld or gyro-stabilized IR imagers.

On the other hand, in an integral inline cryocooler in accordance with embodiments of the invention, the cold finger and compressor may axially overlap. Accordingly, such an integral cryocooler with overlapping cold finger and compressor provides the benefits of both a prior art inline configuration and a side-by-side configuration.

Also, axial overlap between the moving cylinder and cold finger along with the use of a compact magnetic spring enables a common compression space for both the compressor and the warm space of the cold finger, thus minimizing unoccupied volume and minimizing parasitic pressure losses.

FIG. 1 schematically illustrates an example of an integral cryocooler, in accordance with an embodiment of the present invention.

Figure 4A:
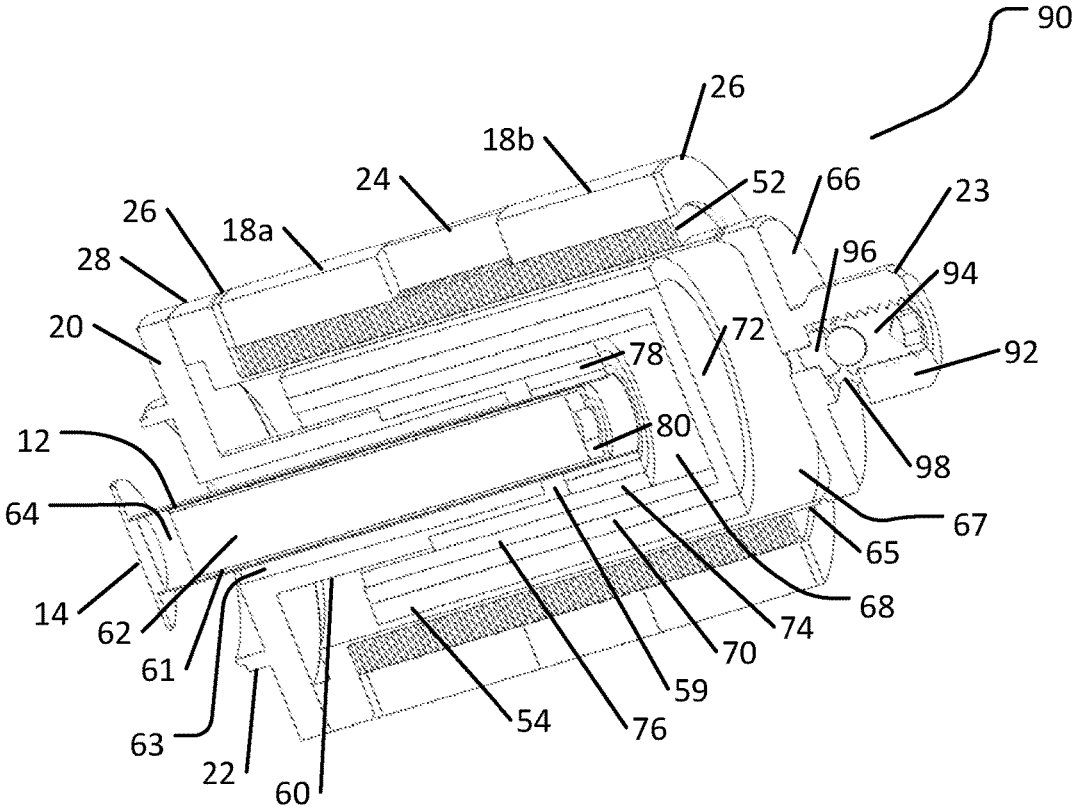
FIG. 4A is a schematic cutaway view of the example of the integral linear cryocooler shown in FIG. 1.

In the example shown, integral cryocooler 10 is configured to cool and maintain at cryogenic temperatures an object that is in thermal contact with cold cap 14 at an exterior tip of cold finger 12. Cold finger housing flange 20 of cold finger housing 60 (FIG. 4A) is attached to cryocooler housing flange 28 of cryocooler housing 65 (FIG. 4A), e.g., by screws (and sealing ring or gasket), by welding, or otherwise so as to form a seal. The sealed connection between cryocooler housing 65 and cold finger housing 60 may enclose pressure vessel back space 67 (FIG. 4A). Pressure vessel back space 67 may be filled with the gaseous working agent, e.g., at high pressure, e.g., via fill/purge valve 23.

Stator assembly 16 (FIG. 3A) includes distal axially magnetized magnet ring 18*a* and oppositely magnetized proximal magnet ring 18*b*, separated by nonmagnetic spacer 24 in the example shown, as well as coaxial driving coil 52 (visible in FIG. 4A). Stator assembly 16 radially surrounds, and is fixed to, the cryocooler housing 65. In the example shown, the outer components of stator assembly 16, together with cryocooler housing 65, form an outer envelope of integral cryocooler 10. In other examples, these components may be enclosed in a housing or casing. In some examples, cryocooler housing 65 may be constructed of a nonmagnetic metal (e.g., stainless steel, titanium alloy or another material). In some cases, stator assembly 16 may be encapsulated, e.g., in a medium or hard polyurethane casting compound. In some cases, stator assembly 16 may be removed from integral cryocooler 10 and replaced with the same or a different stator assembly 16.

Driving coil 52 (FIG. 3A) of stator assembly 16 may be an edgewise-wound coil, and may be connected to an alternating current power supply via proximal coil terminal 27*a* and distal coil terminal 27*b*. In the example shown, end spacers 26 may provide electrical insulation to electrically isolate proximal coil terminal 27*b* and distal coil terminal 27*a* from distal magnet ring 18*a* and proximal magnet ring 18*b*, respectively, or other electrically conducting components of integral cryocooler 10. Spacer 24 and end spacers 26 are typically made of a nonmagnetic and electrically insulating materials.

In the example shown, cold cap 14 of cold finger tube 12 extends distally outward from flange ring 22 of cryocooler housing flange 20 of cold finger housing 60. Flange ring 22, which extends distally outward from cryocooler housing flange 20 around cold finger tube 12, may be customized for connecting integral cryocooler 10 to a shroud of evacuated Dewar assembly, e.g., as shown in FIG. 2.

Figure 2:
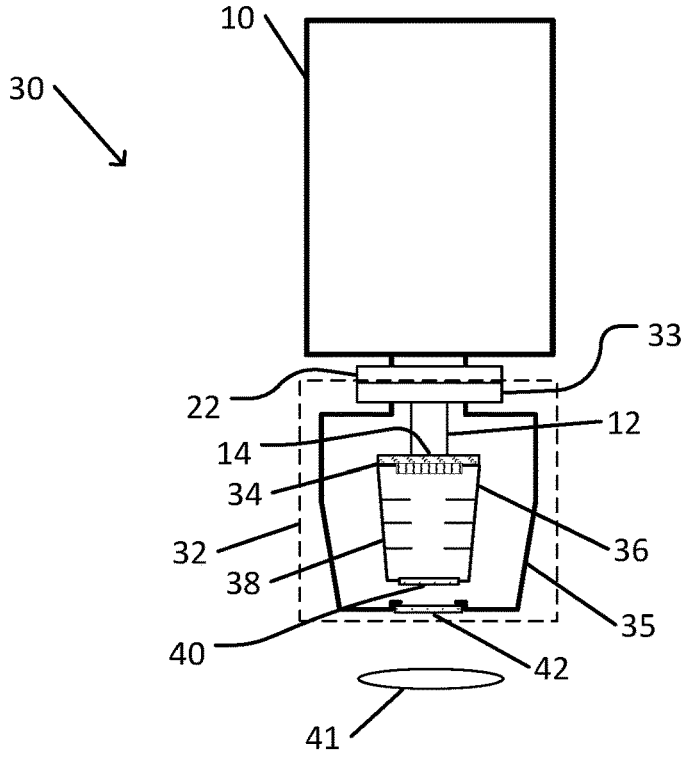
FIG. 2 schematically illustrates an example of an integrated Dewar detector cooled assembly (IDDCA) that is cooled by the linear integral cryocooler shown in FIG. 1.

FIG. 2 schematically illustrates an example of an IDDCA that is cooled by the linear integral cryocooler shown in FIG. 1.

In the example of infrared (IR) IDDCA 30, integral cryocooler 10 is connected to detector subassembly 32 via connection flange 33 of IDDCA 30 and flange ring 22 of integral cryocooler 10. Flange ring 22 may be 11 configured for direct mounting to an optical bench of a system enclosure, and may include features for facilitating optical alignment.

Infrared window 42, at the distal end of shroud 35 of an evacuated envelope that includes shroud 35 and connection flange 33, is transparent to at least one spectral band of infrared radiation.

Cold finger tube 12 extends distally out of integral cryocooler 10 via connection flange 33 to within the evacuated envelope. The distal end of cold finger tube 12 (e.g., cold cap 14) is in thermal contact with the proximal side of detector substrate 34. IR focal plane array (FPA) 36 is integrated with a readout integrated circuit (ROIC) and is mounted on the distal side of detector substrate 34. FPA 36 may be shielded from undesirable scattered radiation by cold shield 38 with internal baffles and by cold filter 40 at the distal end of cold shield 38. Focusing IR imaging optics 41 may be located distal to IR window 42. IR FPA 36 (erroneously shown in figure), which may be cryogenically cooled by integral cryocooler 10, cold shield 38, and cold filter 40 may be thermally insulated from the surrounding environment by a high vacuum that is maintained inside the evacuated envelope (Dewar).

The axial distance between the distal end 22 of integral cryocooler 10 and the distal end of cold cap 14 may be designed so as to be no longer than is necessary to enable placement of detector substrate 34 and cold cap 14, and electrical connections to the substrate and feedthrough terminals, e.g., as determined by the size and shape of the evacuated envelope.

Figure 3A:
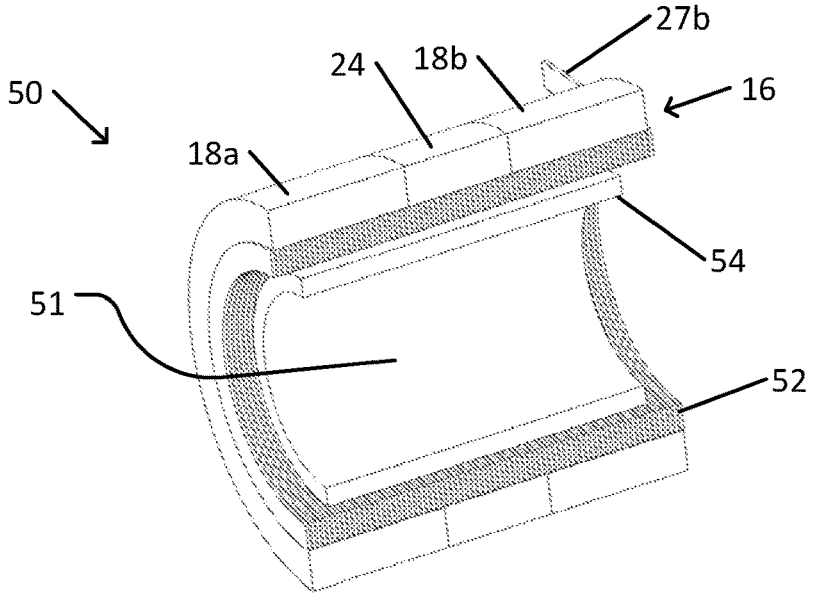
FIG. 3A is a schematic cutaway view of the linear moving iron actuator of the example of an integral linear cryocooler shown in FIG. 1.
Figure 3B:
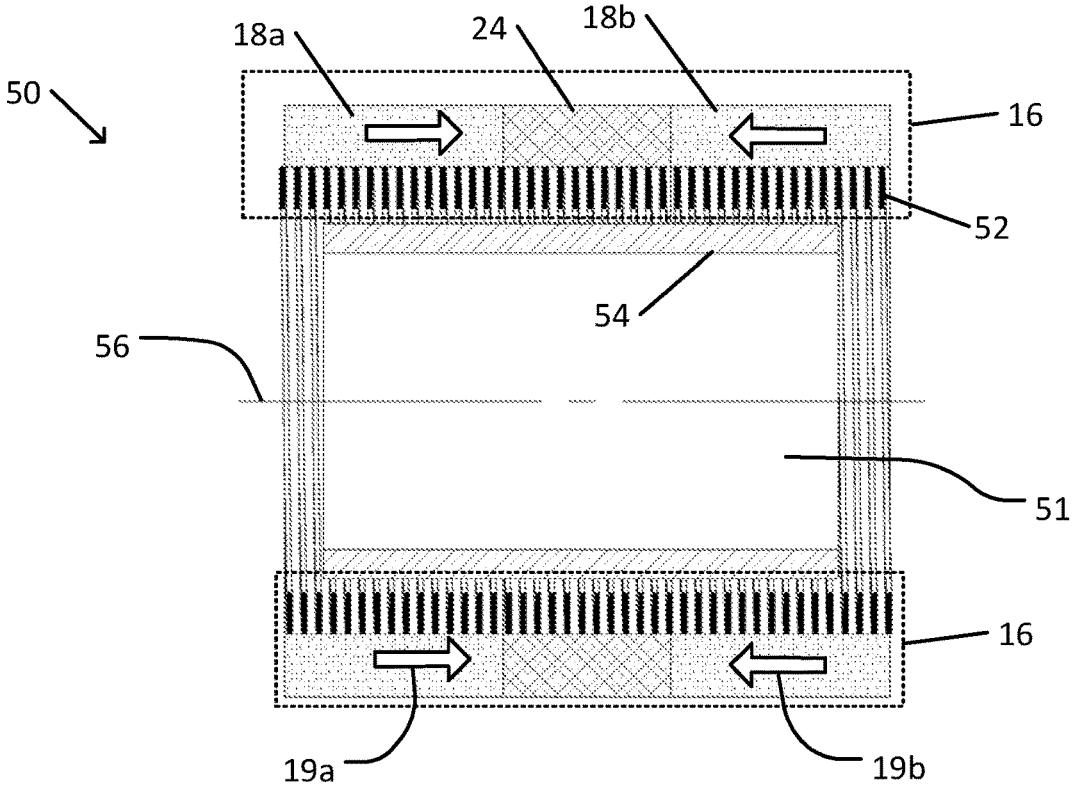
FIG. 3B is a schematic cross-sectional view of the linear moving iron actuator shown in FIG. 3A.
Figure 3C:
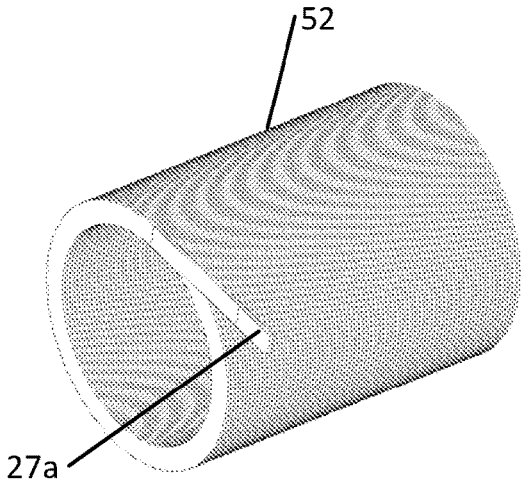
FIG. 3C schematically illustrates a driving coil of the moving iron actuator shown in FIG. 3A.

FIG. 3A is a schematic cutaway view of a moving iron linear actuator of the example of an integral cryocooler shown in FIG. 1. FIG. 3B is a schematic cross-sectional view of the moving iron linear actuator shown in FIG. 3A. FIG. 3C schematically illustrates a driving coil of the moving iron actuator shown in FIG. 3A.

Moving iron linear actuator 50 of integral cryocooler 10 includes a stator assembly 16 and tubular mover 54. Tubular mover 54 is coaxial with stator assembly 16 and is located within central bore 51 of the stator assembly 16. Tubular mover 54 may be made of ferromagnetic material.

Stator assembly 16 includes axially and oppositely magnetized distal magnet ring 18*a* and proximal magnet ring 18*b*, and driving coil 52. Driving coil 52 is made of an electrically conducting material (e.g., copper or another electrically conducting metal or material). Driving coil 52 may be of the edgewise type, which offers a high fill factor in excess of 90%, efficient heatsinking, and low manufacturing costs.

Distal magnet ring 18*a* and proximal magnet ring 18*b* may be cylindrical in shape, their cylinder axes coinciding with longitudinal axis of integral cryocooler 10. The magnetizations of distal magnet ring 18*a* and proximal magnet ring 18*b* are parallel to longitudinal axis 56 and opposite to one another, as indicated by magnetization arrows 19*a* and 19*b*. For example, distal magnet ring 18*a* and proximal magnet ring 18*b* may be sintered from rare earth neodymium-iron-boron powder, grade 48M or 50M, which enables operation in environmental temperatures as high as 85 C. Distal magnet ring 18*a* and proximal magnet ring 18*b* may be protected from corrosion by, for example, nickel electroplating or epoxy resin coating. The components of stator assembly 16 may be encapsulated, e.g., by use of a casting compound.

In the example shown, the outer surface of tubular mover 54 is cylindrical.

Figure 3D:
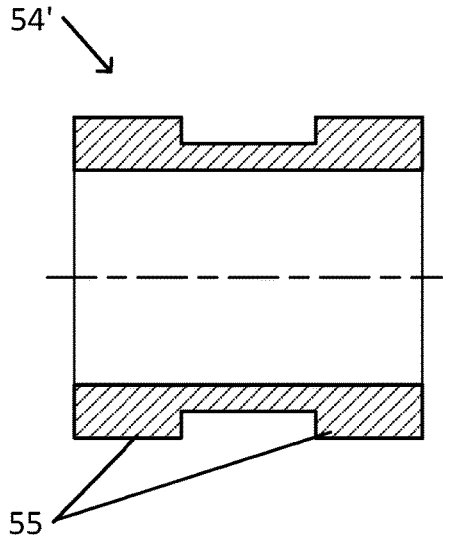
FIG. 3D schematically illustrates a cross section variant of the tubular mover of the moving iron actuator shown in FIG. 3B.

FIG. 3D schematically illustrates a cross section variant of the tubular mover of the moving iron actuator shown in FIG. 3B.

In the example shown, tubular mover 54' is shaped with pole rings 55 that extending radially outward at opposite axial ends of tubular mover 54'. Other shapes and configurations of poles or of tubular movers are possible.

Figure 4B:
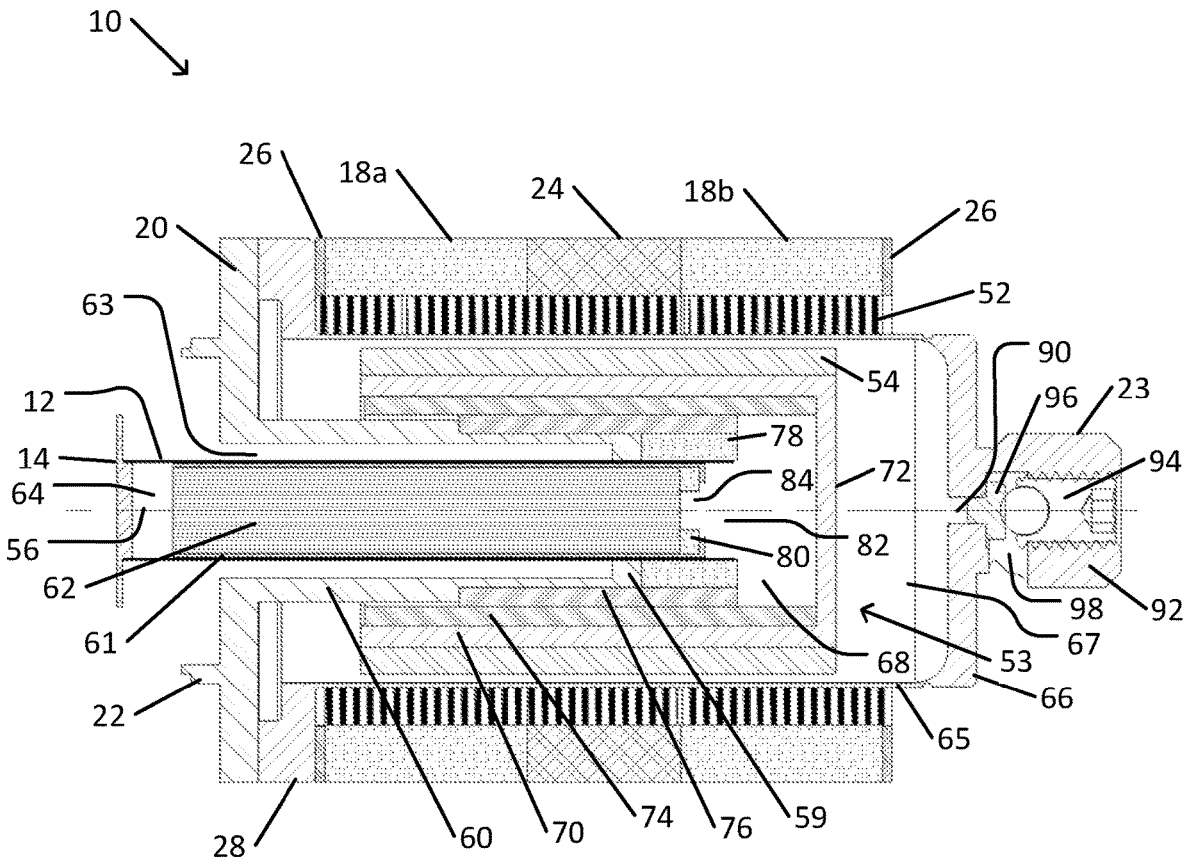
FIG. 4B is a schematic cross-sectional view of the example of the integral linear cryocooler shown in FIG. 4A.

FIG. 4A is a schematic cutaway view of the example of the integral cryocooler shown in FIG. 1. FIG. 4B is a schematic cross-sectional view of the example of the integral cryocooler shown in FIG. 4A.

Tubular mover 54 of cylinder assembly 53 is constructed of, or contains, a ferromagnetic material, having a high saturation polarization and low magnetic coercivity. The ferromagnetic material may include, for example, a cobalt-iron (CoFe) alloy (e.g., VACOFLUX™ or VACODUR™ alloy).

The radial or lateral position of tubular mover 54 (and of cylinder assembly 53 that includes capped movable cylinder 70, tubular mover 54, and cylinder liner 74) may be substantially fixed relative to cold finger housing 60. Capped movable cylinder 70 is configured to axially slide over, e.g., radially outside of, a stationary piston that includes cold finger housing 60, piston liner 76 attached to the outer surface of cold finger housing 60, and any other attached structure. Capped movable cylinder 70 is typically constructed of nonmagnetic material, e.g., a low electrical conductive material such as a titanium alloy (e.g., Ti-6Al-4V) or stainless steel (e.g., SST 304L). The outer surface of capped movable cylinder 70 may be bonded to cylinder mover 54 and its inner surface to cylinder liner 74, e.g., using an adhesive with low outgassing (e.g., Loctite™ 638 or similar adhesive material). At lease a proximal, interior section of the outer surface of cold finger support structure 60 is surrounded by inner liner 76. Piston cylinder 70 may be bonded to piston driver cylinder 54 and to inner liner 76 using an adhesive with low outgassing (e.g., Loctite™ 638 or a similar adhesive).

In the example shown, the inner surface of cylinder liner 74 is adjacent to, and is configured to slide axially over, the outer surface of piston liner 76. Cylinder liner 74 and piston liner 76 are typically constructed of similar wear-resistant material, e.g., a cobalt high speed steel such as M42, or another suitable material. The radial clearance separating cylinder liner 74 and piston liner 76 may be between 10 μm and 14 μm, thus forming a close clearance seal that prevents leakage of the gaseous working agent from compression space 68 to pressure vessel back space 67. During axial sliding of capped movable cylinder 70 over the piston formed by cold finger housing 60 and piston liner 76, piston liner 76 may function as a linear guide for the axial motion of cylinder liner 74. Thus, the motion of cylinder assembly 53 is constrained to axial motion parallel to longitudinal axis 56.

In the example shown, stator assembly 16 is fixed to the section of the outer surface of the cryocooler cover 65 that is axially proximal to cryocooler housing flange 28.

In the example shown, housing cap 66 that caps the proximal end of cryocooler housing 65 may be provided with an axial conduit 90 that connects pressure vessel back space 67 interior to housing cap 66 to the interior of fill/purge valve 23. Tubular bonnet 92 of fill/purge valve 23 extends proximally from housing cap 66. Fill/purge valve 23 may include swivel ball setscrew 94, e.g., with a hexagonal socket, that is placed within a threaded counterbore inside tubular bonnet 92. Sealing disk 96, e.g., made of copper or an aluminum alloy, may be located at a seat of purge/fill valve 23 that surrounds axial conduit 90 at a distal end of the counterbore. The outer surface of tubular bonnet 92 may be threaded to enable a sealed connection to an internally threaded adaptor of a filling tap with a mechanism for screwing or unscrewing swivel ball setscrew 94. Valve conduit 98, e.g., oriented radially, may connect the space at the distal end of the counterbore of tubular bonnet 92 with the adaptor of the filling tap.

Cryocooler housing flange 28 of cryocooler housing 65 may be provided with threaded holes to enable sealed attachment of cryocooler housing 65 to cold finger housing 60. In one example, rear cover 65 may be constructed of a diamagnetic material with low electrical conductance, e.g., a titanium alloy such as Ti-6Al-4V, stainless steel 304L or 316L or another material.

In the example shown, the cold finger tube 12 is supported by support ring 59 of within an elongated space formed by the hollow interior of cold finger housing 60. For example, cold finger tube 12 may be attached to support ring 59 by laser or ion-beam welding, e.g., so as to form a seal. The attachment may be at or near an interior proximal (warm) end of cold finger tube 12. Thus, the length of cold finger tube 12 that is exterior and distal to the attachment to support ring 59 is mechanically isolated from surrounding structure by cylindrical gap 63. Most of the length of cold finger tube 12 is located within the elongated space within cold finger housing 60 that forms cylindrical gap 63. Cylindrical gap 63 may be evacuated to assist in thermally isolating cold finger tube 12 from its surroundings.

In one example, cold finger housing 60 may be constructed of stainless steel. Cold finger tube 12 may be extruded from a cobalt-chromium-tungsten-nickel alloy such as Haynes 25 (L605), with a thickness in the range of 60 μm to 110 μm. Cold cap 14 may be constructed of a material having a low coefficient of thermal expansion, such as 64FeNi iron-nickel (Invar) alloy (e.g., to facilitate failure-free operation when in thermal contact with a ceramic detector substrate 34 or other object to be cooled). These components of the cold finger may be bonded to one another using low heat laser or ion beam welding. Other materials may be used.

In the example shown, an active portion of pressurized gaseous working agent (e.g., helium) is enclosed by lateral walls of cold finger tube 12, cold cap 14 at the distal exterior end of cold finger tube 12, by the cylindrical walls of the cylinder liner 74, and by proximal cylinder cap 72 of capped movable cylinder 70. The outer surface of cylinder liner 74 is fixed to capped movable cylinder 70 which, in turn, is fixed to tubular mover 54, which is driven by magnetic fields produced by stator assembly 16.

In the example shown, the periodic axial reciprocation of cylinder assembly 53, as driven by the interaction of the magnetic fields that are produced by stator assembly 16 with tubular mover 54, periodically compresses and expands the gaseous working agent in compression space 68. The cyclic compression and expansion of the gaseous working agent in compression space 68 results in alternative flow of the gaseous working agent to and from expansion space 64 through the porous material of regenerator, thus exerting an alternating axial drag force on regenerator 62 and, therefore, on displacer 61. For example, the axial force may result from one or more of drag forces applied by flow of the gaseous working agent, excess of the pressure applied to one end of regenerator 62 over the pressure applied to the other end, or other forces.

In the example shown, the displacer 61 is configured to move axially back and forth within the cold finger tube 12, as driven by the drag forces produced by the cyclic flow of the working agent along the material of the regenerative heat exchanger, or regenerator 62, of displacer 61. For example, a radial gap between the outer surface of displacer 61 and the inner surface of cold finger tube 12 may be in the range of 20 μm to 40 μm, thus forming close clearance seals. Displacer 61 is filled with a porous regenerator 62, and, at its proximal end, by displacer magnet ring 80. For example, walls of displacer 61 may be made of a wear resistant plastic material having low thermal conductivity (e.g., polyether ether ketone, commonly referred to as PEEK, or another plastic material). Regenerator 62 typically includes a porous matrix of, e.g., a plastic material such as polyester or nylon. The porous matrix may be in the form of a bundle of axially oriented parallel filaments, wires, strands, or fibers (e.g., of polyester or nylon, e.g., held together by a thin synthetic film that cylindrically wraps around the bundle), or another porous material. The axial motion of displacer 61 alternately moves regenerator 62 between expansion space 64 at a distal, exterior, cold end of cold finger tube 12, and compression space 68 at a proximal, interior, warm end of cold finger tube 12.

In one example, regenerator 62 may be a parallel wire regenerative heat exchanger having an outer diameter in the range of 3 mm to 10 mm, and a length in the range of 20 mm to 50 mm. Each microfiber or wire may have a diameter in the range of 5 μm to 15 μm, with a porosity factor in the range of 65% to 85%.

In the example shown, displacer 61 may be provided with a magnetic spring that includes displacer magnet ring 80 and stationary tubular magnet 78.

Displacer magnet ring 80 is a permanent magnet that is axially magnetized and is attached to displacer 61. In the example shown, displacer magnet ring 80 is located at the proximal end of displacer 61 and includes central opening 84 that enables pneumatic communication between a warm side of regenerator 62 and compression space 62. For example, displacer magnet ring 80 may be connected to the proximal end of displacer 61 using an adhesive (e.g., Resin-Lab Armstrong™ Epoxy Resin Adhesive A-12).

Stationary tubular magnet 78 is fixed relative to cold finger housing 60. Stationary tubular magnet 78 is permanently magnetized in an axial direction that is opposite the direction of the magnetization of displacer magnet ring 80. For example, stationary tubular magnet 78 may be located about an axial section of cold finger tube 12 within which displacer magnet ring 80 is expected to travel during axial motion of displacer 61, and may be sufficiently long to cover that section. The interaction between stationary tubular magnet 78 and displacer magnet ring 80 may create a magnetic spring effect that tends to restore the axial position of displacer 61 to an equilibrium axial position. The spring constant of the magnetic spring and the mass of displacer 61 determine a resonant frequency of the periodic axial motion of displacer 61. In some examples, the rate of magnetic spring may be designed to cause the resonant frequency to equal a predetermined driving frequency. For example, in some cases, efficiency of operation of integral cryocooler 10 may be optimized when the resonant frequency of axial motion of displacer 61 is matched (e.g., equal to or close to) the frequency of the alternating current that is applied to driving coil 52, or otherwise.

The periodic alternating axial motion of the cylinder assembly 53, as driven by the interaction between the magnetic fields that are produced by stator assembly 16 and cylinder mover 54, may periodically and cyclically compress and expand the gaseous working agent in compression space 68. Compression space 68 is in pneumatic communication with expansion space 64 via central opening 84 of displacer magnet ring 80 and regenerator 62. Thus, the motion of piston cylinder 70 may cause a cyclic flow of the gaseous working agent through regenerator 62.

The periodic compression of the gaseous working agent in compression space 68 may apply a periodic distal axial force to regenerator 62 and displacer 61. For example, the distal force may result from drag forces applied by a flow of the gaseous working agent, e.g., in combination with other forces (e.g., excess of the pressure of the gaseous working agent cyclically applied to each end of regenerator 62).

The magnetic spring effect produced by the interaction between displacer magnet ring 80 and stationary tubular magnet 78 may assist in ensuring a required stroke and phase lag of the motion of displacer relatively to the motion of piston cylinder 70.

The cyclical compression and expansion of the gaseous working agent in compression space 68, along with cyclic motion of displacer 61 and regenerator 62, enables cyclical, out of phase, compression and expansion of the gaseous working agent in expansion space 64 at the cold end of cold finger tube 12. During an expansion phase, the compressed and precooled gaseous working agent performs mechanical work on the motion of displacer 61, thus resulting in favorable cooling effect in expansion space 64. The cooled gaseous working agent in expansion space 64 may absorb the heat generated by the cooled object that is in thermal contact with cold cap 14 at the distal end of expansion chamber 64 and cold finger tube 12, thus maintaining the cooled object at cryogenic temperatures. The absorbed heat along with the compression work are rejected to the environment from the compression chamber during the compression phase of the thermodynamic cycle.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. An integral cryocooler comprising:

a cold finger within an elongated space defined inside an elongated housing, wherein a tip of the cold finger freely protrudes outside an opening at an exterior end of the elongated housing, and wherein a root of the cold finger is supported in a cantilevered manner at an interior end of the elongated housing;

a cryocooler cover sealingly connected to the elongated housing to form a pressure vessel; a ferromagnetic mover coaxially fixed to a movable capped cylinder that is located within the pressure vessel and surrounds the interior end of the elongated housing to form a compression space; and a stator, located outside the pressure vessel and comprising two cylindrical permanent magnets with opposite and axial magnetization surrounding a driving coil, such that when an alternating electrical current flows through the driving coil, the movable capped cylinder is moved axially back and forth to alternately compress and expand the compression space.

2. The cryocooler of claim 1, wherein most of a length of the cold finger lies within the elongated space.

3. The cryocooler of claim 1, wherein the cold finger comprises a displacer that is filled with a regenerator and that is configured to move axially back and forth within the cold finger to transfer heat from the tip to the root when the cold finger and the compression space are filled with a gaseous working agent and the alternating current flows through the driving coil, an interior end of the displacer including a displacer magnet in the form of an axially magnetized permanent ring magnet.

4. The cryocooler of claim 3, wherein a tubular magnet whose permanent axial magnetization is opposite to the displacer magnet is fixed relative to the elongated housing such that the displacer magnet is configured to move within the tubular magnet during the axial motion of the displacer to form a magnetic spring.

5. The cryocooler of claim 4, wherein the magnetic spring and displacer are configured such that a resonant frequency of the axial motion of the displacer is equal to a predetermined resonant frequency.

6. The cryocooler of claim 5, wherein the predetermined resonant frequency is equal to a frequency of the alternating electrical current.

7. The cryocooler of claim 3, wherein the regenerator comprises a bundle of axially aligned strands.

8. The cryocooler of claim 7, wherein the strands comprise polyester or nylon strands having diameters in the range of 4 μm to 15 μm.

9. The cryocooler of claim 7, wherein a porosity of the bundle is in the range of 65% to 85%.

10. The cryocooler of claim 1, wherein the root of the cold finger is supported in the cantilevered manner at the interior end of the elongated housing by a support ring that extends radially inward from the elongated housing.

11. The cryocooler of claim 10, wherein the root of the cold finger is laser or ion-beam welded to the support ring.

12. The cryocooler of claim 1, wherein at least a section of an outer surface of the elongated housing includes a piston liner.

13. The cryocooler of claim 12, wherein an inner surface of the movable capped cylinder is fixed to a cylinder liner.

14. The cryocooler of claim 13, wherein a radial clearance between the cylinder liner and the piston liner is between 10 μm and 14 μm so as to form a close clearance seal.

15. The cryocooler of claim 13, wherein the cylinder liner or the piston liner is made of wear-resistant high speed steel.

16. The cryocooler of claim 1, wherein the cryocooler cover includes a fill/purge valve that enables connection of the pressure vessel to a tap.

17. The cryocooler of claim 1, wherein the driving coil is edgewise wound.

18. The cryocooler of claim 1, wherein the cold finger tube comprises extruded cobalt-chromium-tungsten-nickel alloy.

19. The cryocooler of claim 1, wherein the cylindrical permanent magnets comprised sintered neodymium-iron-boron powder.

* * * * *